US005764187A

United States Patent [19]

Rudish et al.

[11] Patent Number: 5,764,187

[45] Date of Patent: Jun. 9, 1998

[54] DIRECT DIGITAL SYNTHESIZER DRIVEN PHASED ARRAY ANTENNA

[75] Inventors: Ronald M. Rudish, Commack; Edward G. Magill, Brooklyn, both of N.Y.

[73] Assignee: AIL Systems, Inc., Deer Park, N.Y.

[21] Appl. No.: 786,229

[22] Filed: Jan. 21, 1997

[51] Int. Cl.[6] ..... H01Q 3/24

[52] U.S. Cl. ..... 342/372; 342/81; 342/154; 342/157

[58] Field of Search ..... 342/81, 157, 154, 342/372, 375

[56] References Cited

U.S. PATENT DOCUMENTS

| | | | |
|---|---|---|---|
| 4,219,811 | 8/1980 | Herman et al. | 343/5 CM |
| 4,996,532 | 2/1991 | Kirimoto et al. | 342/81 |
| 5,500,871 | 3/1996 | Kato et al. | 375/208 |
| 5,541,607 | 7/1996 | Reinhardt | 342/372 |
| 5,640,670 | 6/1997 | Samueli et al. | 455/3.2 |

OTHER PUBLICATIONS

H. Steyskal, *Digital Beamforming at Rome Laboratory*, pp. 100–126, Microwave Journal, Feb. 1996.

*Primary Examiner*—Thomas H. Tarcza
*Assistant Examiner*—Dao L. Phan
*Attorney, Agent, or Firm*—Hoffmann & Baron, LLP

[57] ABSTRACT

A digitally beam formed phased array antenna capable of both transmitting and receiving signals is constructed from a series of digitally controlled antenna elements. To transmit signals, a series of direct digital synthesizers is used to drive the antenna elements forming the phased array. Each direct digital synthesizer is programmed from a common digital processor with specific time and phase delay information such that the signals from the array combine to form a desired antenna pattern. To receive signals, signals from each antenna element in the phased array are processed by analog to digital converter. The digitized signals are then preprocessed in a time and phase delay preprocessor which receives time and phase delay information from a corresponding direct digital synthesizer prior to signal combining in a common digital processor. The digitally beam formed antenna, thus formed, allows for remote reconfiguration, flexible partitioning, and generation of multiple and independent beams from a single phased array.

7 Claims, 12 Drawing Sheets

DIRECT DIGITAL SYNTHESIZER DRIVEN PHASED ARRAY ANTENNA

BACKGROUND OF THE INVENTION

1. Field of the Invention

The present invention relates generally to radio signal antennas and more particularly relates to phased array antennas with digital antenna pattern control.

2. Description of the Prior Art

It is well known in the prior art that antennas for radiating and receiving radio signals may be formed from several individual antenna elements. By arranging the antenna elements with specific geometry, and combining signals associated with the individual elements with a specific phase and amplitude relationship, the individual elements cooperate to form a unitary antenna structure.

Each of the individual antenna elements in such an antenna (in a transmit application) radiates a common signal which is common in frequency, but altered in amplitude and phase from the other elements. As a result, the individual signals combine in space at varying phase and amplitude levels to create an antenna pattern. The signal combination essentially follows a three dimensional vector addition function. The combination of signals which are in phase results in signal lobes. The cancellation of signals which are out of phase (180°) results in signal nulls. For all phase angles in between these extremes, partial cancellation occurs which shapes the signal lobes. The resultant signal is referred to as the antenna pattern. The antenna pattern is characterized by the number of lobes, the magnitude of the lobes (gain), the direction of the lobes and the relative magnitude of the lobes in differing directions (directivity).

In multi-element array antennas, the gain, directivity and lobe direction may be varied by controlling the phase of the signals driving the individual elements. This type of antenna is conventionally referred to as a phased array. An in depth treatment of conventional phased arrays is presented in *The Radar Handbook*, Second Edition, Edited by Merrill Skolnik, published in 1990 by McGraw-Hill, which is incorporated herein by reference.

Phased arrays may be formed as linear arrays (FIG. 1), planar arrays (FIG. 2), or conforming arrays (FIG. 3). The linear array shown in FIG. 1 is capable of producing an antenna pattern which can be rotated along (scanned) a two dimensional plane by varying the phase of the signals driving each of the antenna elements 2. The planar and conforming arrays are capable of scanning in three dimensional space by appropriately driving the individual antenna elements 2.

Regardless of the chosen array geometry, it is required that the signal along each path between a signal source and the antenna elements have a controlled phase and magnitude in order to form a desired antenna pattern. This is achieved by controlling signal power division ratios and the phase shift in the electrical transmission path between the signal source and each antenna element. A structure which performs this function is generally referred to as an antenna feed.

FIG. 4 illustrates a conventional "corporate feed" antenna feed topology. In a corporate feed, a signal source 4 simultaneously drives, in parallel, each of the antenna elements 2. In a corporate feed, the length of each transmission line segment 6 is the same for each antenna element 2. The phase of the signal driving each element is controlled by an analog phase shift network 8. For a variable antenna pattern, each antenna element 2 will have an individually controllable analog phase shift network 8.

An alternative antenna feed network, a series feed, is illustrated in FIG. 5. In the conventional series feed network, a series of antenna elements 2 are connected in a single transmission line 6 with a built in phase progression between the antenna elements 2. The phase progression is determined in part by the length of the transmission line 6 (physical path length) between successive antenna elements 2. The phase of the signal at each element 2 is related to the electrical path length between antenna elements 2. The electrical path length, expressed in wavelengths, changes with frequency for a fixed physical path length. Therefore, the phase progression between antenna elements 2 in a series feed varies with frequency. For variable antenna patterns, variable analog phase shift networks 8 may be inserted between the antenna elements 2.

A third conventional antenna feed network, a space feed network, is illustrated in FIG. 6. In the space feed network, a source antenna 10 is electrically connected to a signal source 4. The source antenna 10 radiates a signal received from the signal source 4. The radiated signal is received by a series of pickup elements 12. The received signals are then coupled through phase and amplitude shift networks 9 to the antenna elements 2 for transmission.

The antenna feed topologies illustrated in FIGS. 4, 5 and 6 each require the use of analog phase shift networks in line with each antenna element to achieve dynamic antenna pattern control or scanning. Analog phase shift networks require tuning during manufacturing and are not directly controllable by a digital signal from a computer. Further, analog circuitry is subject to significant parametric variation with changing environmental conditions, such as ambient temperature. In high power signal transmission applications requiring high speed variation of the antenna pattern, the phase shift network must be implemented at a low signal power level. The phase shifted signals must then be amplified subsequently for each antenna element. Phase shifting before final power amplification avoids significant power loss caused by the high speed analog phase shifters. The combination of these factors makes analog phase shifters difficult to manufacture and complex to control in an automated beam scanning system.

The problems associated with analog phase shift networks have been addressed in receiving antenna systems by the implementation of digitally beam formed (DBF) receiver antennas. A typical receive-only DBF antenna is illustrated in FIG. 7. In a receive DBF antenna, the antenna elements 2 of the phase array are coupled to analog to digital (A/D) converters 20. Typically, signal amplifiers will be interposed between the antenna elements 2 and A/D converter 20, to increase the received signal level. Signal mixers may also be interposed between the antenna elements 2 and A/D converter 20 to convert the frequency of the received signals into the operating range of the A/D converter 20.

Each A/D converter 20 digitizes the received signals from antenna elements 2 and presents a digital signal to a digital processor 22. The digital processor 22 mathematically alters the magnitude and phase of the received digital signals. The digital processor 22 then combines these altered signals to synthesize the desired antenna pattern. In this fashion, a receive antenna is formed without the need for analog phase converter. However, the DBF antenna of FIG. 7 is only applicable for radio signal receiving systems, not transmission systems.

OBJECTS AND SUMMARY OF THE INVENTION

It is an object of the present invention to provide a digitally beam formed antenna suitable for use with a signal transmission system.

It is another object of the present invention to provide a signal transmission antenna which has software control of the number of signal beams, the signal beam shapes, the signal beam pointing directions, signal wave forms and signal frequencies.

It is still another object of the present invention to provide a digitally beam formed antenna suitable for use in both signal transmission and reception systems.

It is yet another object of the present invention to provide a highly stable signal source combined with a digitally beam formed transmit and receive antenna suitable for coherent radar processing.

It is a further object of the present invention to provide a phased array antenna which can be reconfigured remotely to alter the antenna patterns.

It is still a further object of the present invention to provide a phased array antenna which can be remotely configured as subarrays, overlapping or not, to generate independently controllable beams from a single array antenna.

It is still a further object of the present invention to provide a simplified transmit array architecture which eliminates conventional antenna feed structures and analog phase and time delay shifters.

In accordance with one form of the present invention, a phased array antenna is formed having a series of direct digital synthesizers operatively coupled to a series of antenna elements. The antenna elements are combined to form a phased array antenna. Each element of the array is operatively coupled to an individual direct digital synthesizer. The individual direct digital synthesizers are driven by a common clock and generate signals which are controlled by a common digital processor. The digital processor establishes the required phase relationship between the signals being fed to the antenna elements.

In accordance with another form of the present invention, a digitally beam formed antenna is formed which is capable of both transmitting and receiving signals. The transmit portion of the digitally beam formed antenna includes a series of direct digital synthesizers operatively coupled to a series of antenna elements which are assembled as an antenna array. The antenna elements are further coupled to a series of analog to digital converters for signal reception. Signals from the analog to digital converters are coupled to receiver phase and time delay preprocessors (RPTD). Each RPTD receives phase and time delay information from a corresponding direct digital synthesizer and applies this information to the received analog to digital converter signals. The received and transmitted signals are processed by a digital processor which controls the phase, frequency and time delay of the signals to create the desired antenna beam pattern.

Previously, digitally beamed formed antennas were only suitable for use in receive only applications. Conventional phased array antennas suitable for transmit applications require the use of complex feed networks and analog phase and time delay shifters.

Surprisingly, by implementing a phased array antenna wherein each element of the array is operatively coupled to an individual direct digital synthesizer, a highly flexible transmit phased array antenna may be formed. The use of the direct digital synthesizer allows precise control of the phase and time delay of the signals being coupled to the transmit antenna elements. This allows direct digital control of both the transmit and receive antenna pattern for wide frequency band operation.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 8:
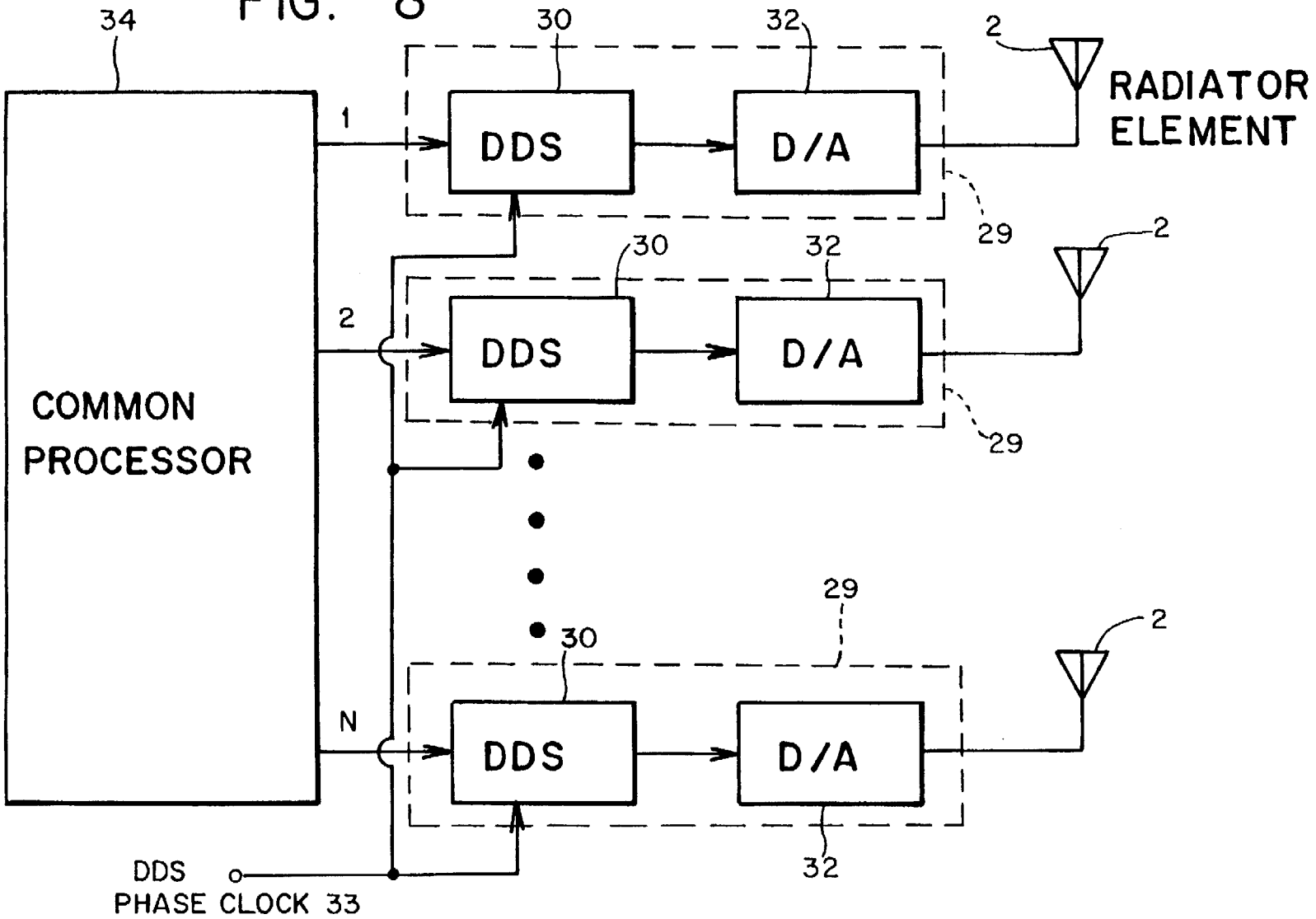
FIG. 8 is a block diagram of a digitally beam formed antenna for transmitting signals, formed in accordance with the present invention.

A digitally beam formed (DBF antenna) phased array suitable for use in a signal transmission system, and formed in accordance with the present invention, is illustrated in FIG. 8. A summary of the operation of the present invention can be appreciated by referring to FIG. 8. A number of digitally controlled signal generators (DCS) 29 generate signals to be transmitted. The signal from each DCS 29 is operatively coupled to a corresponding radiator element 2. Each DCS 29 must be capable of precisely controlling the phase of the generated signal in response to received digital control signals. The digital control signals for the DCS 29 are generated by a digital processor 34. By maintaining precise control of the generated transmit signals coupled to each radiator element 2, the signals cooperatively combine in space to establish a desired antenna beam pattern.

Figures 8A, 8B, 8C:
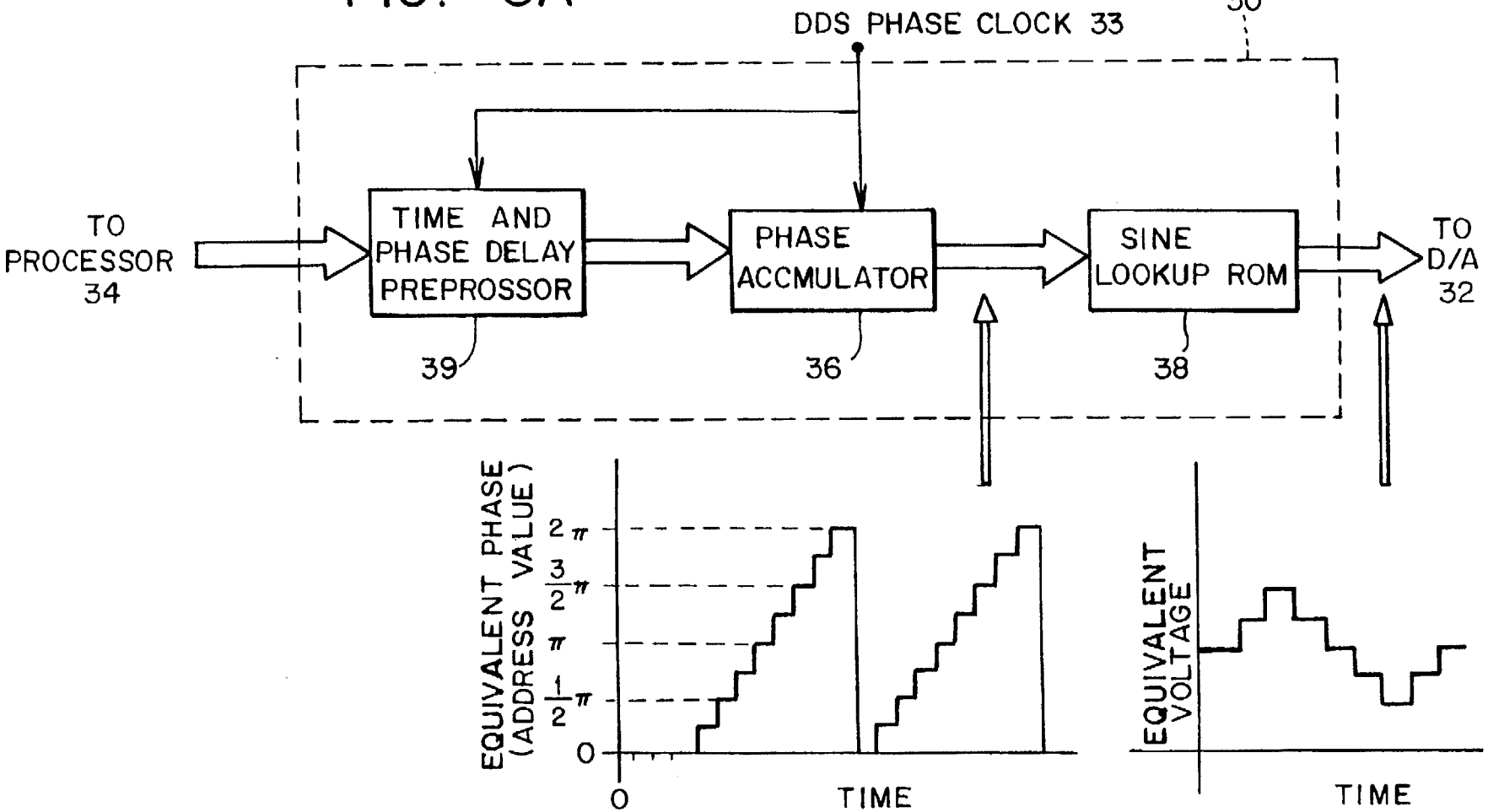
FIG. 8A is a block diagram of a direct digital synthesizer used in the present invention.
FIGS. 8B and 8C are graphical representations of signals generated within the direct digital synthesizer of FIG. 8A.

Preferably, the DDS 29 will take the form of a direct digital synthesizer (DDS) 30 operatively coupled to a digital to analog converter (D/A) 32. Each DDS 30 generates a digital sine wave signal representing the transmit signal (FIG. 8C). The digital sine wave signal from each DDS 30 is characterized by a frequency value, a phase value and a time delay value. Each of these values is independently controllable by digital control of the DDS 30. The phase relationship between each DDS 30 is maintained by the use of a common clock signal 33. The D/A 32 is responsive to the digital sine wave signal and generates an analog radio signal. The analog radio signal from each D/A 32 is operatively coupled to a corresponding radiator element 2.

The DDS 30 is shown in further detail in the block diagram of FIG. 8A. The DDS 30 includes a phase accumulator 36 and a sine look-up read only memory (ROM) 38 which are conventional to a DDS. FIGS. 8B and 8C illustrate representative signals which are generated by the phase accumulator 36 and sine look-up ROM 38 respectively. (It should be understood that while the signals are illustrated graphically, these signals are actually digital numeric values represented by the steps of these graphs.) The diagram of FIG. 8B is shown as a ramp which is composed of a series of discrete steps. Each step represents an address value for the sine look-up ROM which corresponds to a specific phase value in a sine wave signal. The start of the ramp represents 0° ( 0 radians). The final step represents 360° ($2\pi$ radians).

The phase resolution of the DDS 30 is determined by the number of steps used to generate the ramp. For example, if a phase accumulator is used which generates 1024 steps (i.e., 10 bit phase accumulator), the phase resolution of the DDS 30 will equal 360°/1024 steps, or 0.35° per step. As more bits are added to the phase accumulator 36, the phase resolution of the DDS 30 is improved.

Preferably, each DDS 30 will further include a time and phase delay pre-processor (TPDP) 39. Each TPDP 39 receives specific time delay and phase delay information for the corresponding DDS 30 from the digital processor 34. Upon receipt of an initiation signal from the digital processor 34, the TPDP 39 will allow operation of the corresponding DDS 30 to commence in accordance with the received time and phase delay information.

Each TPDP 39 controls the time and phase of a corresponding DDS 30 by controlling the time when the phase accumulator 36 begins operating. The operation of the TPDP 39 results in the graphs of FIG. 8B and 8C shifting to the left or right in time (with respect to the signals generated by the other DDS's in the array), in accordance with the received time and phase delay information from the processor 34. In this way, the radio signals from each DDS 30 are generated with precise relative phase and time delay control without the need for analog phase and time delay shifters.

The TPDP 39 can effect the addition or subtraction of a phase constant to the sum in the accumulator 36 in order to bring about an abrupt change in beam steering or beam shape. The TPDP 39 can alter the phase as a function of time to dynamically change the beam direction or shape. Further, if TPDP 39 alters the phase value of the accumulator identically for each radiator element 2, the beam parameters will not change with time, but the transmitted signal will be phase or frequency modulated. It should be appreciated that it is not necessary for the TPDP 39 to be integral to the DDS 30. Alternatively, the TPDP 40 may be a separate element, or may be integrated within the processor 34.

Figure 1:
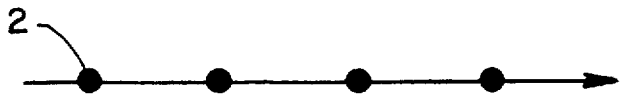
FIG. 1 (PRIOR ART)
FIG. 1 is an illustrative pictorial diagram of a linear array antenna known in the prior art.
Figure 2:
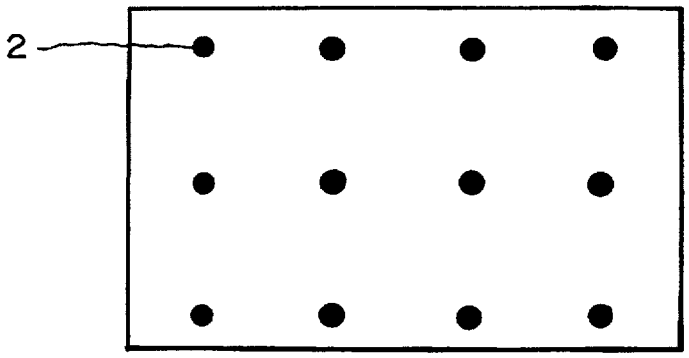
FIG. 2 (PRIOR ART)
FIG. 2 is an illustrative pictorial diagram of a planar array antenna known in the prior art.
Figure 3:
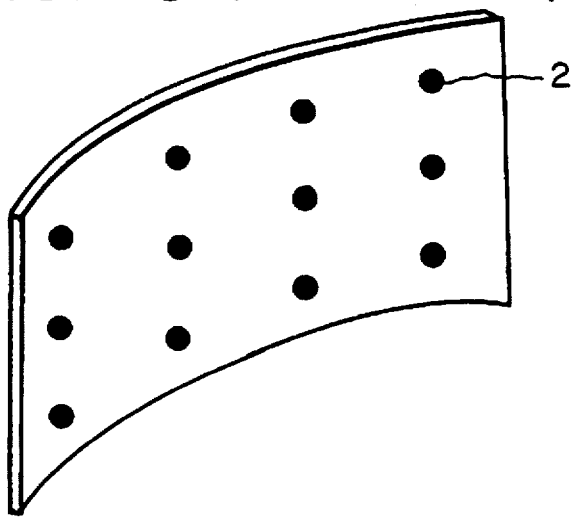
FIG. 3 (PRIOR ART)
FIG. 3 is an illustrative pictorial diagram, in perspective, of a conforming array antenna known in the prior art.
Figure 4:
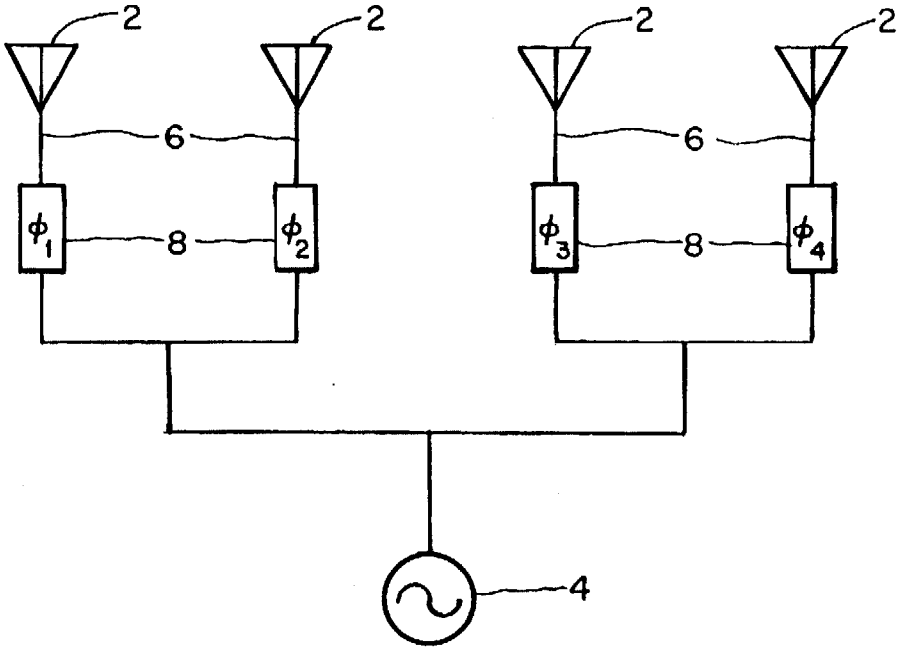
FIG. 4 (PRIOR ART)
FIG. 4 is a schematic diagram of a corporate feed network for an array antenna known in the prior art.
Figure 5:
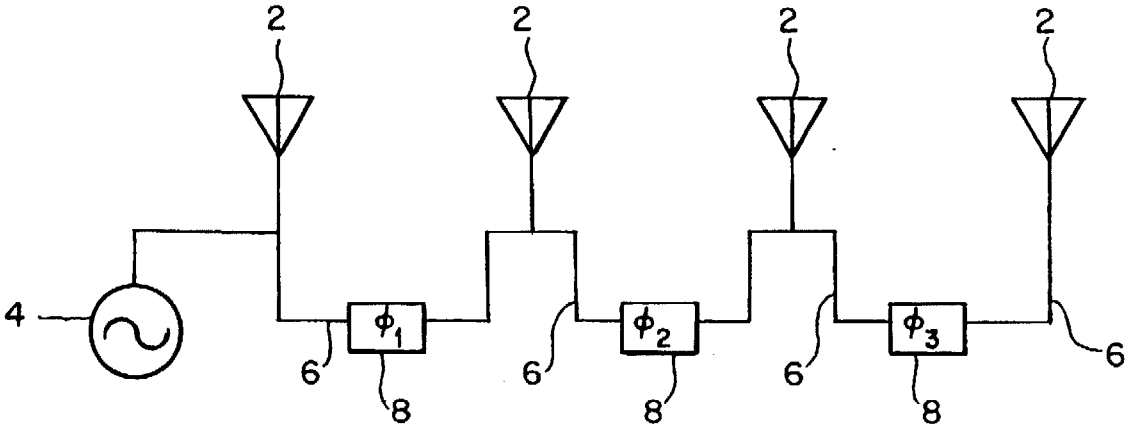
FIG. 5 (PRIOR ART)
FIG. 5 is a schematic diagram of a series feed network for an array antenna known in the prior art.
Figure 6:
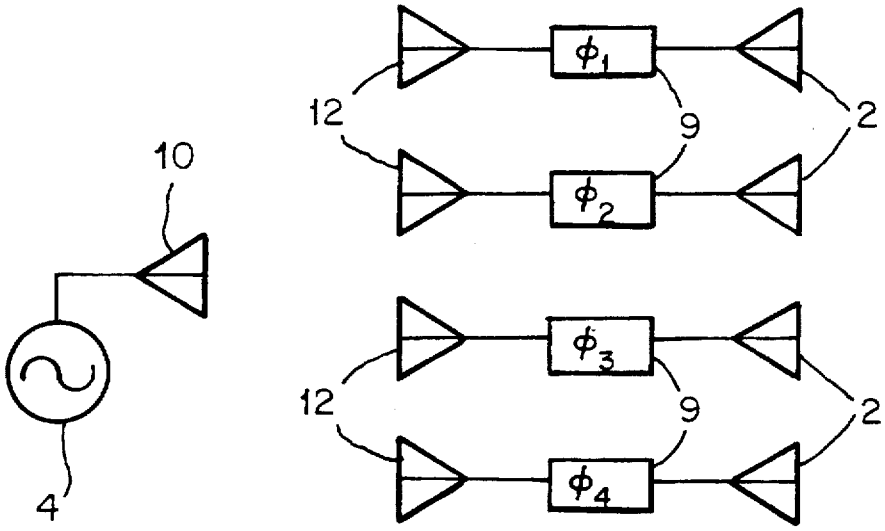
FIG. 6 (PRIOR ART)
FIG. 6 is a schematic diagram of a space feed network for an array antenna known in the prior art.
Figure 7:
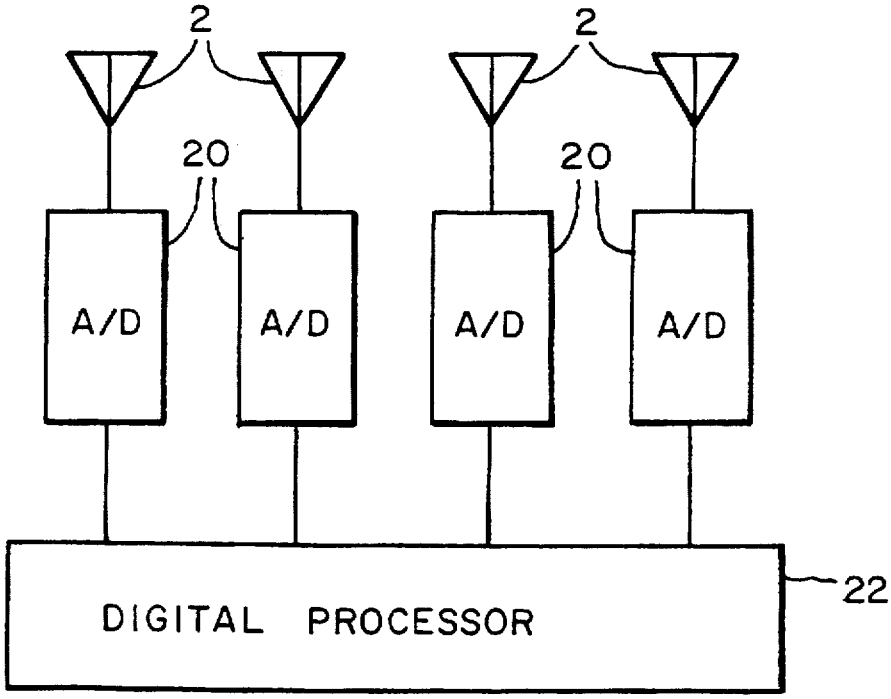
FIG. 7 (PRIOR ART)
FIG. 7 is a block diagram of a digitally beam formed antenna for signal reception known in the prior art.
Figure 9:
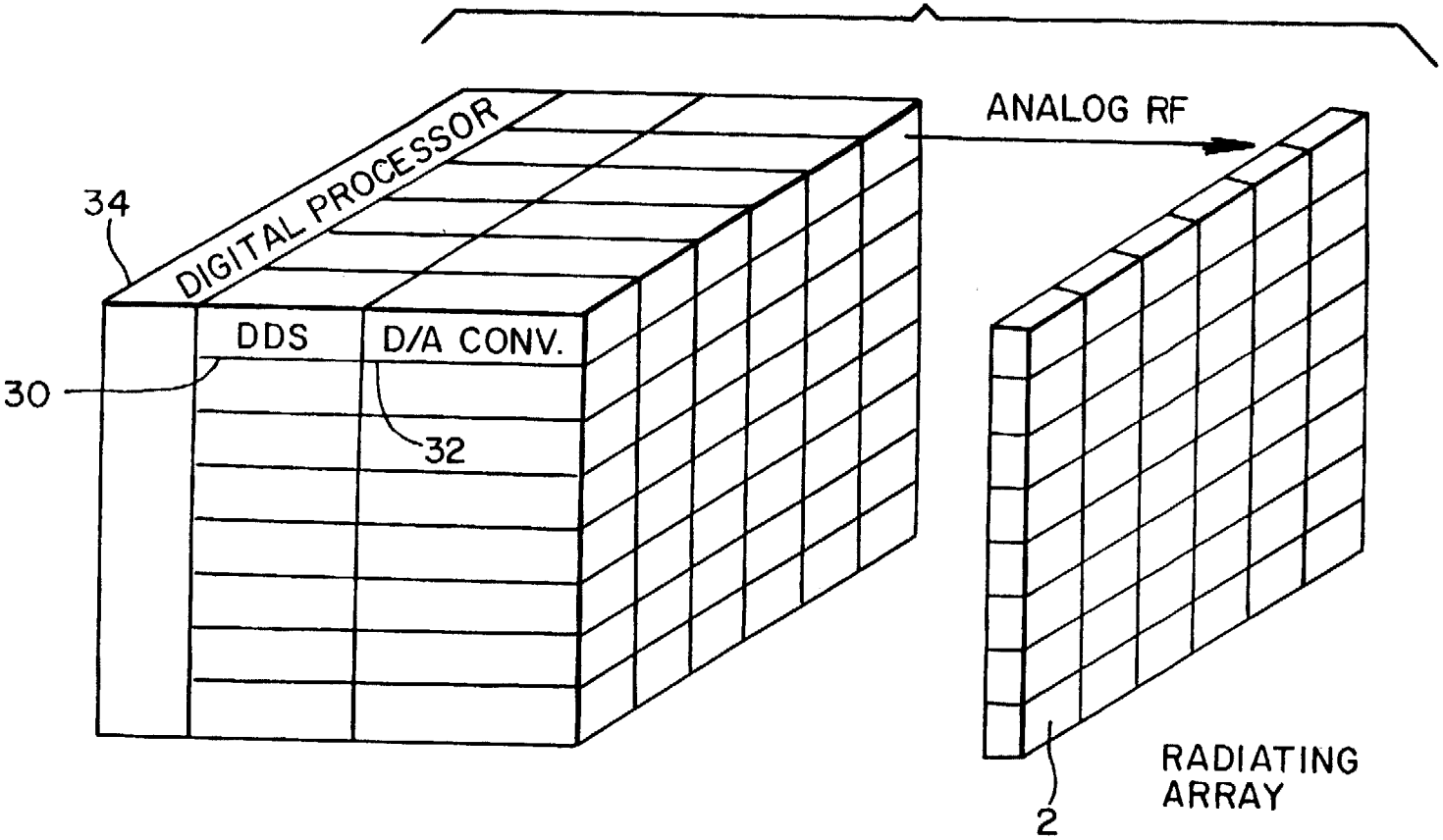
FIG. 9 is a block diagram showing the elements of the transmit digitally beam formed antenna arranged in a planar array, in accordance with one embodiment of the present invention.

Each coupled DDS 30, D/A 32, and radiator element 2 combine to form a single transmit element of a phased array structure. A block diagram illustrating the assembly of the elements is shown in FIG. 9. The arrangement of FIG. 9 is for a planar array, such as that initially shown in FIG. 2. However, the present invention is also suitable for implementing linear arrays (FIG. 1) and conforming arrays (FIG. 3). The number of transmit elements which are used to form the array may be as few as two. The upper boundary on the number of transmit elements used will be determined by the beamwidth and gain requirements, as well as the constraints on size, cost and available processing power to operate the resultant phased array.

Figure 10:
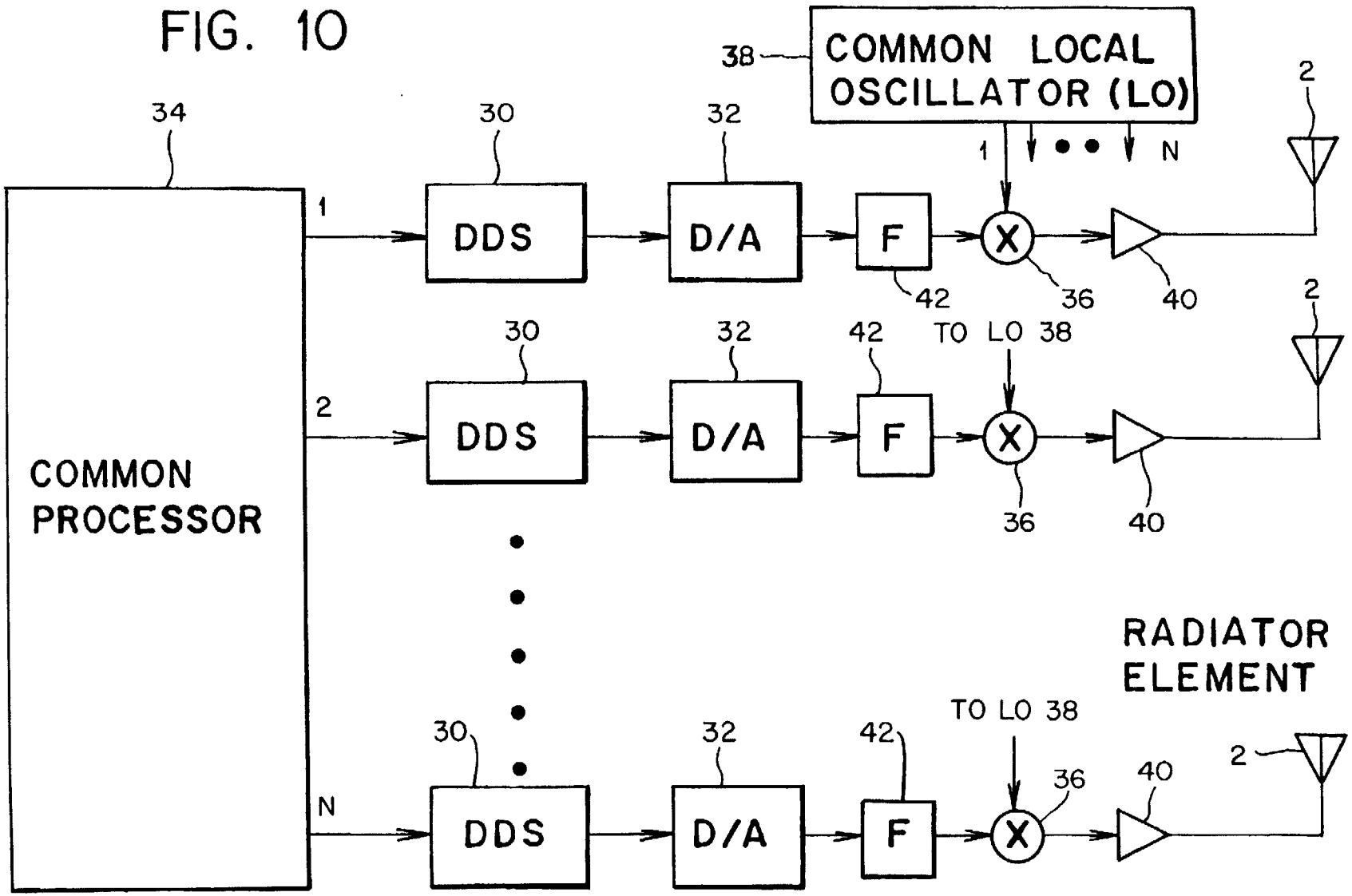
FIG. 10 is a block diagram illustrating an alternate embodiment of a digitally beam formed antenna in accordance with the present invention.

The block diagram of FIG. 10 illustrates an alternative embodiment of the present invention suitable for high frequency operation. Because the upper frequency limit of conventional direct digital synthesizers is typically several hundred megahertz or less, it is preferable in many applications to operatively couple a hetrodyning circuit between each D/A 32 and corresponding radiating element 2. One embodiment of a hetrodyning circuit includes a mixer 36. The mixer 36 is responsive to both the signal from the D/A converter 32 and a common local oscillator (LO) signal generated by an LO 38. A general purpose mixer typically generates a plurality of signals including the received LO (carrier) signal and two sideband signals. The two sideband signals have frequency values equal to the sum and the difference of the LO signal and the D/A converter output signal frequencies respectively.

Preferably, the mixer 36 is a single side band, suppressed carrier device which only generates one of the desired sum or difference sideband signals. If a general purpose mixer is used, it will be desirable to include a filter (not shown) after the mixer 36 to eliminate any unwanted signal components. Alternatively, the hetrodyning circuit may be replaced by a frequency multiplier circuit, interposed between each DDS 30 and antenna element 2 for the purpose of increasing the D/A signal frequency by a fixed multiplying factor.

In addition to the hetrodyning circuit, FIG. 10 further illustrates the use of signal amplifiers 40 and "smoothing" low pass filters 42. Each low pass filter 42 is preferably interposed between the D/A 32 and the mixer 36 to "smooth" the analog signal from the D/A 32 by removing any steps which may be present on the signal as a result of this signal being digitally generated. Signal amplifiers 40 are interposed between the mixers 36 and the radiator elements 2. The signal amplifier 40 is selected to provide desired gain to the mixer output signal prior to radiation from the radiator element 2. The signal amplifiers 40 and low pass filters 42 are conventional elements in the art of radio system design.

Figure 8D:
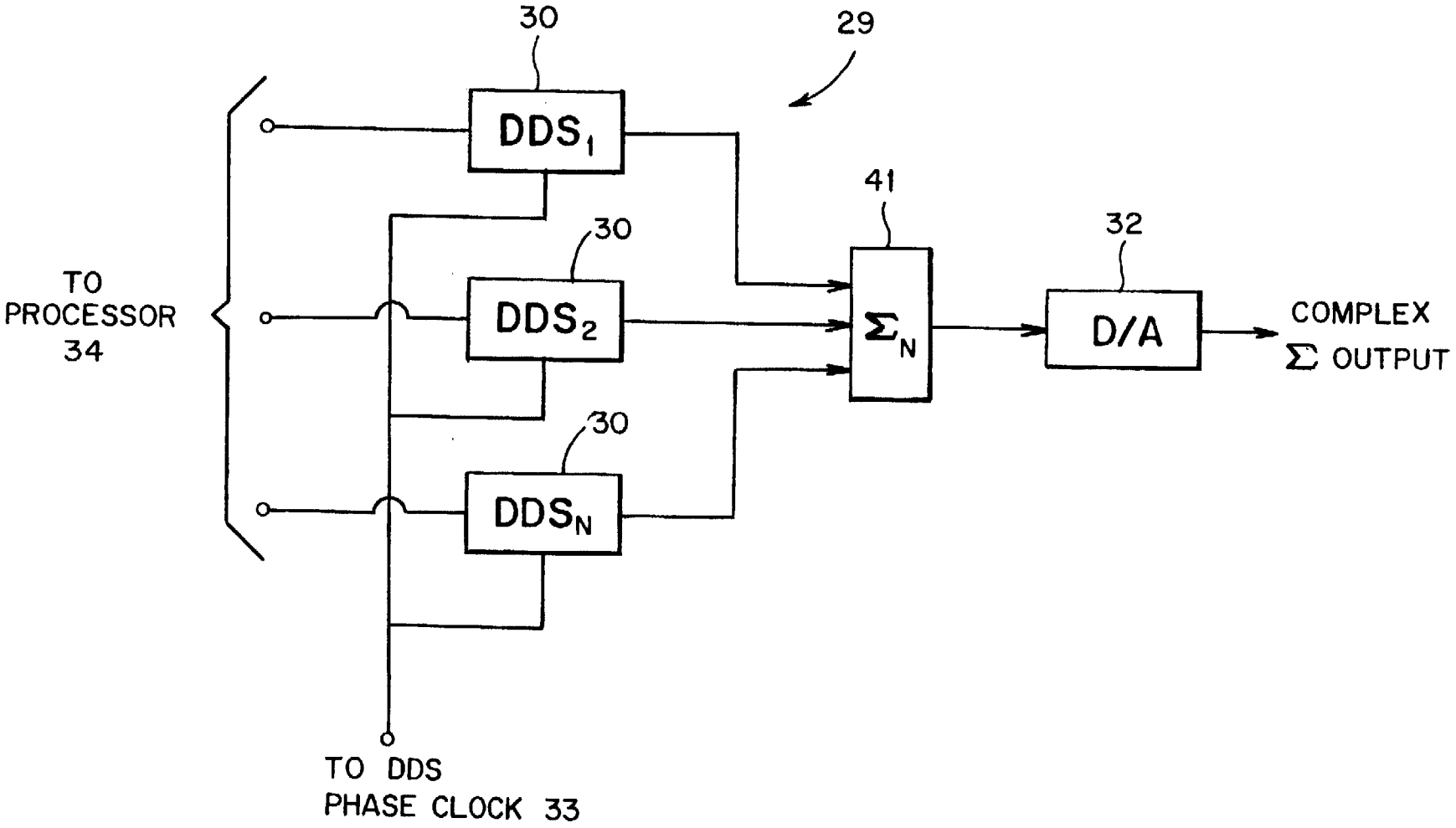
FIG. 8D is a block diagram of a digitally controlled signal generator capable of generating complex waveforms in accordance with the present invention.

An embodiment of the present invention which is capable of generating complex wave forms and independent multiple beams sharing the same aperture is illustrated in FIG. 8D. FIG. 8D shows an implementation in which each digitally controlled signal generator 29 includes multiple DDS 30. A digital summation circuit (adder) 41 is responsive to the signals from each of the DDS 30 and generates a sum signal. The sum signal is a complex digital waveform which is the result of superposition of the discrete sinusoidal signals from each DDS 30. The adder 41 is followed by a D/A 32. The D/A 32 responds to the digital sum signal by generating an analog signal which includes the sinusoidal frequency components from each DDS. In this configuration, the entire radiator array (FIG. 9) may be used to simultaneously generate multiple antenna beams.

Figure 8E:
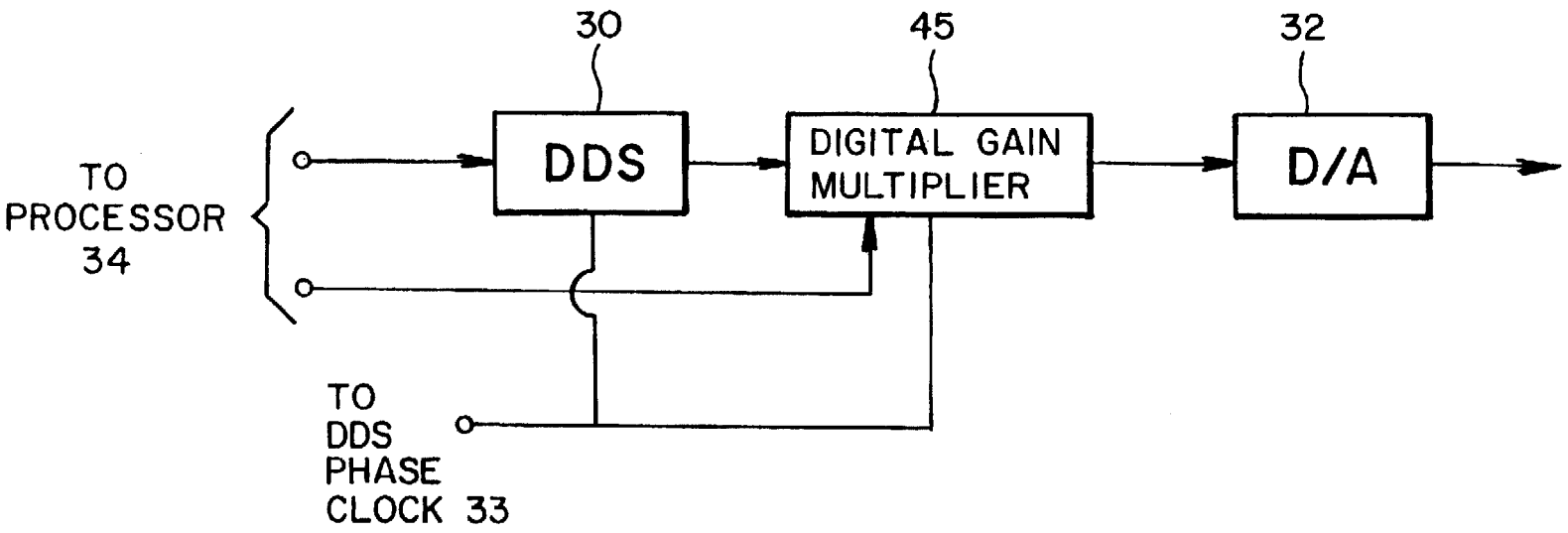
FIG. 8E is a block diagram of a digitally controlled signal generator, with variable gain control, formed in accordance with the present invention.

The present invention may also be configured with variable gain control associated with each digitally controlled signal generator 29. FIG. 8E illustrates one embodiment for varying the signal gain. Referring to FIG. 8E, a variable digital gain multiplier block 45 is interposed between the DDS 30 and D/A 32. Under the control of processor 34, the digital gain multiplier 45 scales the equivalent analog magnitude parameter of the digital sine wave signal generated by the DDS 30. By controlling the signal gain in each signal generator 29, the embodiment is capable of imparting an amplitude taper across the radiating array for controlling the side lobes of the antenna beams. Also, gain control may be used to generate amplitude modulated signals. As an alternative to the digital gain multiplier 45, a variable gain analog amplifier may be interposed between the D/A 32 and the radiator element 2.

Figure 11:
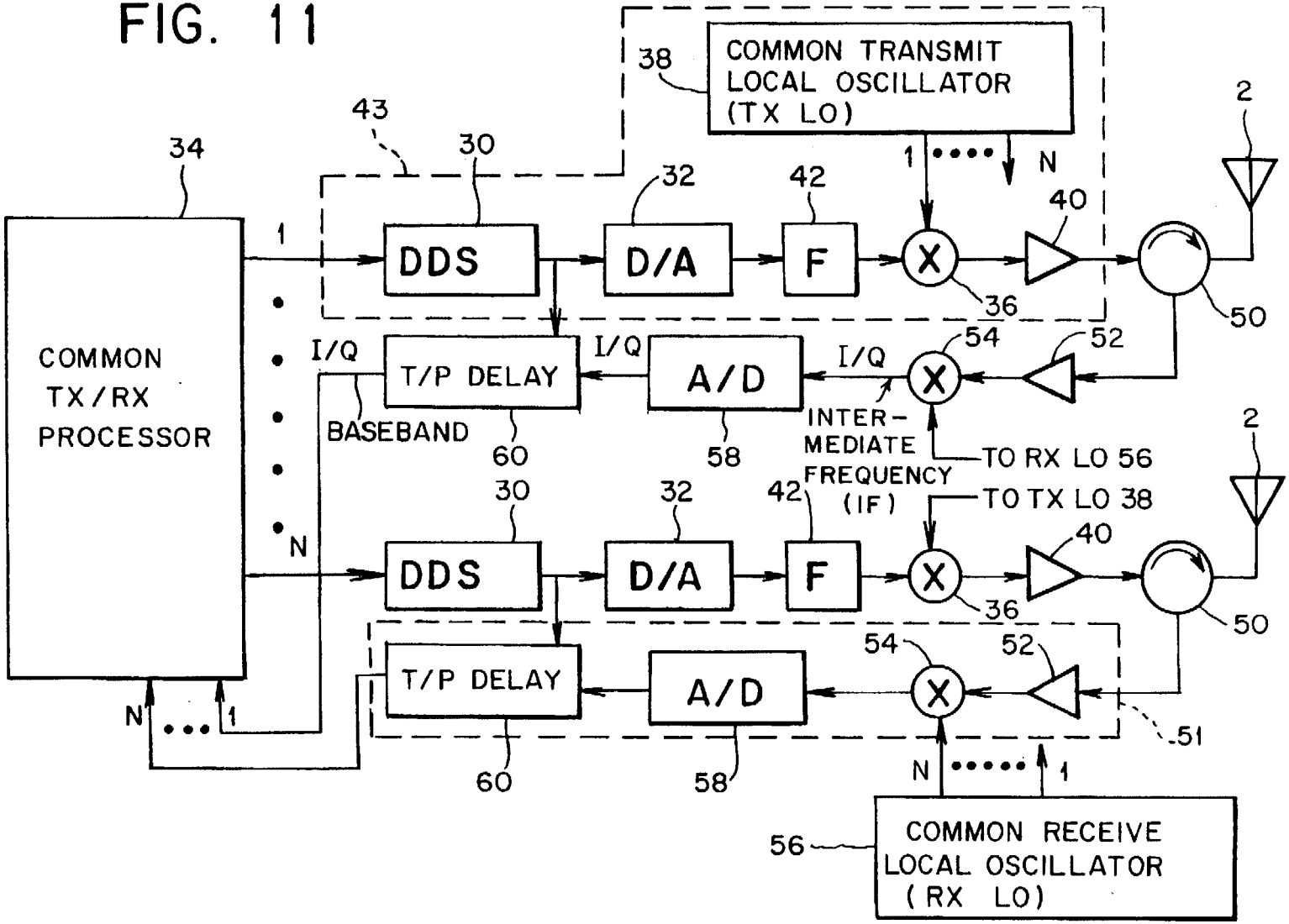
FIG. 11 is a block diagram of a digitally beam formed antenna for transmitting and receiving signals, formed in accordance with the present invention.

A DBF antenna suitable for use in both transmit and receive applications is illustrated in the block diagram of FIG. 11. The DBF antenna of FIG. 11 is composed of a number of transmit units 43 and, preferably, an equal number of receive units 51. The transmit units 43 are formed essentially as previouslydescribed in connection with the transmit DBF antenna illustrated in FIG. 10. The transmit and receive units are operatively coupled as transmit/receive pairs and cooperate as a transmit/receive element of the DBF antenna. Each transmit/receive element is operatively coupled to one of a plurality of antenna elements 2.

The coupling of each antenna element 2 to the transmit units 43 and receive units 51 is preferably achieved by use of a circulator 50. The circulator 50 is a three port device which directs the flow of signals in a single direction, thereby isolating the transmit unit and receive unit signal paths. For each transmit/receive element, the antenna element 2 is operatively coupled to one port of the circulator 50. In the transmit unit signal path, the circulator 50 is preferably interposed between the signal amplifier 40 and the antenna element 2. In the receive unit signal path, signals which are electromagnetically received by an antenna element 2 are passed through the circulator 50 and are directed to a front end receive amplifier 52. As an alternative, transmit/receive switches, hybrid splitters or diplexers may be used in place of the circulator 50 to direct signals into the proper signal path.

The front end receive amplifier 52 amplifies the signals received from the circulator 50. The amplifier 52 is operatively coupled to an I/Q mixer 54, which is responsive to the amplified signals. The I/Q mixer 54 also receives a receiver local oscillator (RX LO) signal from an RX LO 56. The RX LO 56 may be the same oscillator as that used for the transmit LO 58, or may be a separate operational block as shown. The I/Q mixer 54 shifts the received signal down in frequency and generates in phase (I) and quadrature (Q) intermediate frequency (IF) signals. The I/Q IF signals have a frequency value which is equal to the difference between the received signal frequency and the RX LO signal frequency. The I and Q signals are equal in frequency, but are separated in phase by 90°. This relationship is referred to as a quadrature or sine/cosine relationship.

It is necessary to generate the I and Q signals in a receive path in order to recover both phase and amplitude signal parameters. In a phase sensitive application such as a DBF antenna, the I and Q channels, which are separated by 90°, are processed to determine the actual phase of the incoming signal. This process is conventional in the art of signal recovery and decoding.

Each receive unit further includes an analog to digital converter (A/D) 58. The A/D 58 is responsive to the I/Q IF signals from the I/Q mixer 54 and creates two digital signals representing the I and Q IF signals. Alternatively, mixer 54 may be a conventional mixer which generates a single IF signal. The I/Q quadrature signals may then be generated by the processor, this alternative requires the A/D 58 to operate at a much higher rate than the case where the I/Q signals are from the I/Q mixer.

Figure 12:
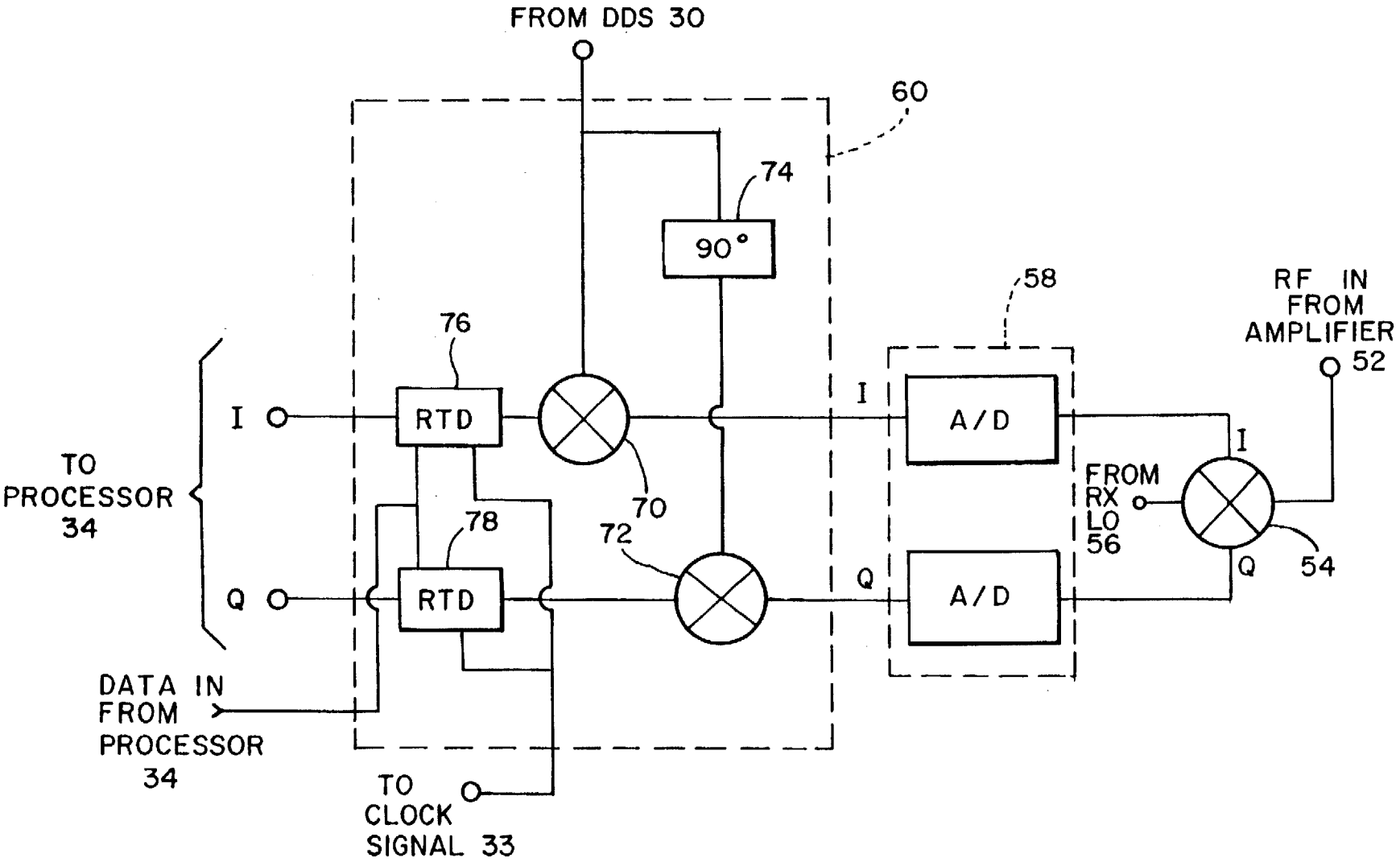
FIG. 12 is a block diagram further illustrating a section of the receive portion of the antenna structure of FIG. 11.

The digital I and Q signals from A/D 58 are fed into a receiver time and phase delay preprocessor (RTPD) 60. The RTPD 60 is shown in detail in FIG. 12. Referring to FIG. 12, the RTPD 60 is further illustrated having first and second digital multipliers 70, 72 and a digital phase shifter 74. The digital I and Q signals from A/D 58 are electrically coupled to the digital multipliers 70 and 72 respectively. The first and second digital multipliers 70, 72 are also responsive to the digital sine wave signal (illustrated in FIG. 8C) generated by the DDS 30. The first digital multiplier 70 receives the digital sine wave signal and multiplies this signal with the digital I signal. The first digital multiplier generates a first multiplier signal representing this multiplication product.

The digital phase shifter 74 is interposed between the second digital multiplier 72 and the DDS 30. The digital phase shifter 74 is responsive to the digital sine wave signal and generates a quadrature signal. The quadrature signal is a replica of the digital sine wave signal, but is shifted in phase by 90°. Alternatively, the DDS 30 may be constructed with both a sine and cosine lookup tables to provide both in-phase and quadrature signals. The second digital multiplier 72 receives the quadrature signal and multiplies this signal with the received Q signal. The second digital multiplier generates a second multiplier signal representing this multiplication product.

Each receive unit 51 further includes a first real time delay element (RTD) 76 and a second RTD 78. The first RTD 76 and second RTD 78 receive the first and second multiplier signals respectively. The first and second multiplier signals are imputed with the phase information embedded in the DDS digital sine wave signal. However, after each DDS 30 completes one complete sine wave cycle, the relative real time delay between the digital sine wave signals is effectively lost. The RTD's 76, 78, which are controlled by the processor 34, add a controlled and synchronous time delay to the first and second multiplier signals and generate first and second receive element signals respectively.

The first and second receive element signals from RTPD 60 represent digital base-band data for a corresponding receive unit antenna element 2. Unlike conventional receive DBF antennas, the receive DBF antenna of the present invention applies phase and time information into each antenna element signal path prior to beamforming. This relieves the processor 34 of the processor-intensive phase and time delaying in the receive signal path.

Returning to FIG. 11, the base band receive element signals from each receive unit are fed into the common TX/RX processor 34. The processor 34 combines the signals from each element path and generates a signal representing energy within the digitally-formed antenna beam. The digital processor 34 performs the signal combination by implementing a digital matched filter or other similar receiver function. Because the time and phase information has already been applied to each elemental I and Q signal, processor 34 is a simpler device than would be required to implement a conventional receive only DBF antenna. In FIG. 11, the processor 34 is shown as a common receive and transmit processor. While this is preferred, separate processors may also be used to implement the transmit and receive processing functions.

As a result of the highly flexible nature of the DDS 30 for generating variable phase, frequency and time delayed signals, the DBF antenna of the present invention is also very flexible. An array formed in accordance with the present invention can be remotely reconfigured through software to change the operating frequency of the signals transmitted and received and the modulation characteristics of the transmitted signal. The beam direction and the scanning properties of the DBF antenna may also be configured remotely via software.

Figure 13:
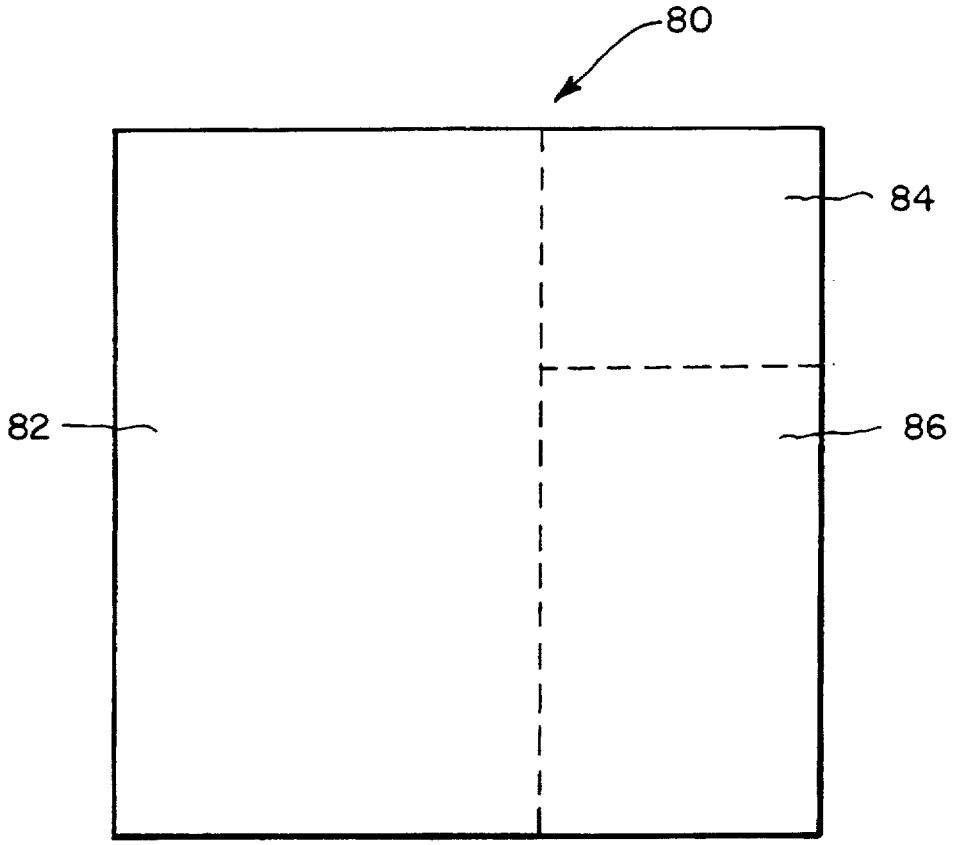
FIG. 13 is an illustrative pictorial diagram, front view, of a digitally beam formed antenna configured as a planar array, the planar array being subdivided as independently operable sub-arrays in accordance with the present invention.

A DBF antenna array in accordance with the present invention may be partitioned to act as independent subarrays. Referring to FIG. 13, a planar array 80 is shown subdivided as three subarrays 82, 84 and 86. This particular subdivision is exemplary and it should be understood that the specific geometry and number of possible sub-arrays are vast. The subarrays can overlap, partially or completely, to share aperture space. In the case where subarrays overlap, the excitations for each subarray are combined by digital addition before D/A conversion as illustrated in FIG. 8D. The gain of each sub-array is proportional to the number of elements used to implement the sub-array. The beam direction and frequency of operation of each sub-array are otherwise independently and remotely controllable via software.

Figure 13A:
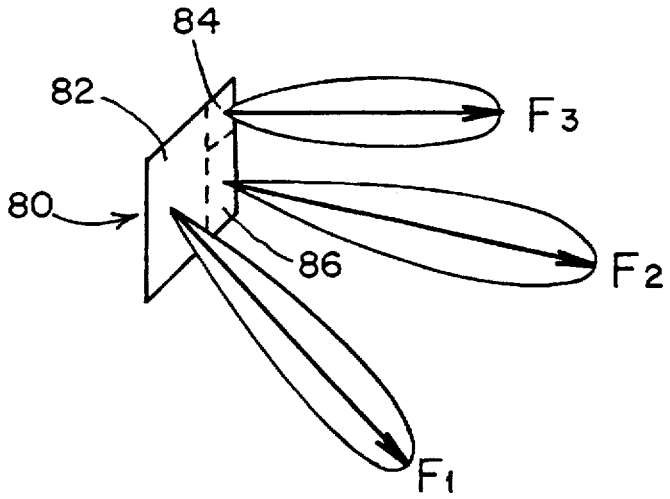
FIG. 13A is an illustrative pictorial diagram, in perspective, of the digitally beam formed antenna of FIG. 13 further illustrating exemplary antenna beams generated by the subarrays.

As is shown in FIG. 13A, the planar array of FIG. 13 is capable of generating multiple beams. Each beam is capable of operating at an independent frequency and in independent directions from the other beams. Unlike conventional phased arrays, the subarrays 82, 84, 86 may be instantaneously altered by changing the programing to each DDS 30. This is an important benefit in satellite systems where remote configuration allows for system upgrading without the need for retrieving and reconfiguring existing satellites, or deploying new satellites. This is also an important benefit in repeater applications where it is desirable to receive a signal from one direction, and re-transmit the signal in another direction.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A digitally beam formed array antenna system for transmitting and receiving signals, the antenna system comprising:

a digital processor;

a plurality of antenna elements for receiving and transmitting signals;

a plurality of transmit units, each of the plurality of transmit units comprising a digitally controlled signal generator generating at least one transmit signal having a time, a phase and a frequency parameter, the parameters being variable and responsive to the digital processor, at least one of the transmit signals from each digitally controlled signal generator being a transmit element signal, the transmit element signal being operatively coupled to at least one of the antenna elements, whereby the transmit element signals radiate from the antenna elements and combine in space to form an antenna pattern;

a plurality of receive units, each receive unit corresponding to one of the plurality of transmit units, each receive unit comprising:

an analog to digital converter, the analog to digital converter being operatively coupled to one of the plurality of antenna elements and receiving radio signals therefrom, the analog to digital converter generating a digital A/D signal representing the received radio signals; and a time and phase delay preprocessor (TPDP), the TPDP being responsive to the digital A/D signal and responsive to at least one of the transmit signals generated by one of the plurality of transmit units, the TPDP applying the phase, time and frequency parameters from the transmit signal to the digital A/D signal and generating a receive element signal; and the digital processor being responsive to the receive element signal generated by each of the receive units, the digital processor combining the receive element signals into a receive antenna pattern signal.

2. A digitally beam formed array antenna system, as defined by claim 1, wherein each of the plurality of the digitally controlled signal generators further comprises:

a direct digital synthesizer, the direct digital synthesizer being responsive to the digital processor and generating a digital sine wave signal, the digital sine wave signal having the phase, the frequency and the time parameters therein;

a digital to analog converter, the digital to analog converter being responsive to the digital sine wave signal and generating the transmit element signal; and wherein the at least one transmit signal to which the TPDP is responsive is the digital sine wave signal.

3. A digitally beam formed array antenna system, as defined by claim 2, wherein each of the transmit units further comprise a plurality of hetrodyning circuits interposed between each of the plurality of digitally controlled signal generators and each of the plurality of antenna elements, each of the plurality of hetrodyning circuits being responsive to one of the transmit signals from one of the plurality of digitally controlled signal generators and generating a frequency translated signal which is operatively coupled to the antenna element.

4. A digitally beam formed array antenna system, as defined by claim 3 wherein:

each transmit unit hetrodyning circuit further comprises a mixer, the mixer receiving the transmit signal from one of the plurality of digitally controlled signal generators; and wherein the antenna system further comprises a common receive local oscillator, the receive local oscillator generating a frequency output signal which is operatively coupled to each of the plurality of mixers, each mixer generating a frequency translated signal which has a frequency value which is substantially equal to one of a sum and difference of a transmit element signal and the frequency output signal.

5. A digitally beam formed array antenna system, as defined by claim 4, wherein each receive unit further comprises a receive unit hetrodyning circuit, the receive unit hetrodyning circuit being interposed between the analog to digital converter and one of the plurality of antenna elements, each receive unit hetrodyning circuit being responsive to signals received by one of the plurality of antenna elements and generating at least one intermediate frequency signal.

6. A digitally beam formed array antenna system, as defined by claim 5, wherein:

the receive unit heterodyning circuits further comprise a receive mixer, the receive mixer receiving the radio signal from one of the plurality of antenna elements; and wherein the antenna system further comprises a common receive local oscillator, the receive local oscillator generating an LO output signal which is operatively coupled to each of the plurality of receive mixers, each receive mixer generating the at least one intermediate frequency signal having a frequency which is substantially equal to the difference between the radio signal and the LO output signal.

7. A digitally beam formed array antenna system, as defined by claim 6 wherein the at least one intermediate frequency signal further comprises I and Q intermediate frequency signals, the I and Q intermediate frequency signals being equal in frequency and separated in phase by 90 degrees; and each TPDP further comprises:

a first digital multiplier, the first digital multiplier being responsive to the digital sine wave signal from a corresponding transmit unit DDS and one of the I and Q intermediate frequency signals, the first digital multiplier generating a first receive element signal;

a digital phase shifter, the digital phase shift unit being responsive to the digital sine wave signal from the corresponding transmit unit DDS and generating a quadrature digital sine wave signal, the quadrature digital sine wave signal being a replica of the digital sine wave signal which is shifted in phase by 90 degrees; and a second digital multiplier, the second digital multiplier being responsive to the quadrature digital sine wave signal and one of the I and Q intermediate frequency signals not received by the first digital multiplier, the second digital multiplier generating a second multiplier signal;

a first real time delay, the first real time delay receiving the first multiplier signal, applying a delay to the signal in response to the digital processor and generating a first receive element signal; and a second real time delay, the second real time delay receiving the second multiplier signal, applying a delay to the signal in response to the digital processor and generating a second receive element signal.

* * * * *